US008464566B2

(12) United States Patent
Neumann et al.

(10) Patent No.: US 8,464,566 B2
(45) Date of Patent: Jun. 18, 2013

(54) METHOD OF MANUFACTURING A VALVE HOUSING

(75) Inventors: Walter Neumann, Kupferzell (DE); Gerhard Koch, Moeckmuehl (DE); Robert Pop, Stuttgart (DE); Klaus Beck, Oberkochen (DE); Klaus Siegert, Sindelfingen (DE)

(73) Assignee: Buerkert Werke GmbH, Ingelfingen (DE)

( * ) Notice: Subject to any disclaimer, the term of this patent is extended or adjusted under 35 U.S.C. 154(b) by 63 days.

(21) Appl. No.: 13/156,401

(22) Filed: Jun. 9, 2011

(65) Prior Publication Data

US 2012/0047978 A1 Mar. 1, 2012

(51) Int. Cl.
*B21D 26/02* (2006.01)

(52) U.S. Cl.
USPC ..... 72/57; 72/58; 72/61; 29/421.1

(58) Field of Classification Search
USPC ..... 72/54, 57, 58, 61, 62; 29/421.1
See application file for complete search history.

(56) References Cited

U.S. PATENT DOCUMENTS

| | | | | |
|---|---|---|---|---|
| 3,300,844 | A * | 1/1967 | Boteler | 72/61 |
| 5,396,786 | A * | 3/1995 | Bartholomew et al. | 29/421.1 |
| 5,485,737 | A * | 1/1996 | Dickerson | 72/57 |
| 5,735,156 | A * | 4/1998 | Yoshitomi et al. | 72/57 |
| 5,746,079 | A * | 5/1998 | Hettinger et al. | 72/57 |
| 6,487,886 | B2 * | 12/2002 | Ueno et al. | 72/57 |
| 6,776,953 | B1 * | 8/2004 | Hulsberg et al. | 72/58 |

* cited by examiner

*Primary Examiner* — David B Jones
(74) *Attorney, Agent, or Firm* — Carlson, Gaskey & Olds PC

(57) ABSTRACT

A method of manufacturing a metallic valve housing by hydroforming a tube section in a die is provided. The die includes an upper part having a stamp and a lower part having a depression. The tube section is placed in the die, filled with a liquid, and subjected to a high internal pressure. Opposite walls of the tube section in a middle portion between two tube ends is shaped in that one side of the tube section is pressed inwards transversely to the axis of the tube section by the stamp to form a concave curvature, and the opposite wall is pressed into the depression in the lower part to form a flat.

15 Claims, 14 Drawing Sheets

METHOD OF MANUFACTURING A VALVE HOUSING

RELATED APPLICATION

This application claims priority to German Application No. 10 2010 023 855.4, which was filed Jun. 15, 2010.

FIELD OF THE INVENTION

The present invention relates to a method of manufacturing a metallic valve housing.

BACKGROUND

EP 0 726 103 discloses a method of manufacturing metallic valve housings in which, proceeding from a tube section, a valve housing is manufactured by metal forming. The tube section is filled with a plastically deformable material, in particular wax, closed at its ends by obturating stamps, and deformed by a stamp by the action of an external force. The internal pressure developing in the process presses the wall of the deformed tube section against an outer mold, whereby the contour of the valve housing is obtained.

In connection with this method it has been found that the tolerances of the valve housing manufactured in this way are highly dependent on the quantity of the wax filled in. Even minor variations in the amount of filling material have a strong effect on the internal pressure produced in the tube section, which results in that it is not ensured that the wall of the tube section always fully adapts to the contour of the outer mold.

Even though the known method already offers great advantages over the prior art at that time, such as the manufacture as a cast or forged housing, it is still complicated and includes a great many method steps that need to be performed in succession: The tube section is filled with wax, which is melted out after the metal forming process. Subsequently, a cleaning step is required. Due to the variations in dimensions, the outside diameter of the opening produced in the shaped tube section needs to be finished by turning, the opening serving as a connection interface for a drive in the finished valve housing.

There is a need to improve the known method of manufacturing metallic valve housings such that quite a few process steps are saved, that is, the economic efficiency is increased, and very close tolerances on the housings produced can be met.

SUMMARY

In a method of manufacturing a valve housing, first a tube section is placed in a die having an upper part and a lower part, the upper part including a stamp and the lower part including a depression. Subsequently, the tube section is filled with a liquid and a high internal pressure is applied to the section. The stamp is then pushed inwards transversely to the axis of the tube section in a middle portion situated between two tube ends, almost as far as to the opposite wall, so that a concave curvature is formed that corresponds to the shape of the stamp. At the same time, the wall opposite thereto is pressed towards the depression in the lower part of the die by the high internal pressure to form a flat. The invention is based on the fundamental idea of actively generating the internal pressure necessary for the shaping by acting on the interior of the tube with high pressure before the stamp is inserted, rather than "passively" by the insertion of the stamp. The high internal pressure made use of in the process of manufacturing the valve housing according to the invention ensures in an advantageous manner that the original wall of the tube section completely adapts to the contour of the stamp and of the die, which provides for the high limit of accuracy desired. After severing off the flat, the openings produced in the valve housing blanks more particularly have inside diameters exhibiting a very high dimensional accuracy.

While the middle portion of the tube section experiences a shaping to such a great extent that the original tube geometry is changed completely here, the shape of the tube ends is not changed.

But the tube section may also be shaped additionally in the region of the tube ends by using high internal pressure. To this end, appropriate further depressions are in that case arranged in the upper and lower parts of the die.

The metallic valve housing blank manufactured in this way is machined further is a known manner: the flat is severed off to form an opening, the annular collar that is left is beaded around a flange, and the flange and the annular collar are subsequently connected with each other by welding.

In the finished valve housing, the tube ends serve as fluid input and output and the concave curvature serves as a threshold and valve seat separating them from one another. With an open valve, the fluid input and output communicate with each other and fluid can flow from the fluid input via the threshold and to the fluid output.

Where such terms as "upper" and "lower" are used here to describe the method and the die, this serves for greater clarity of the description and is not meant to be limiting in any way. The method works in the same way if the stamp is arranged in the lower part and the depression is arranged in the upper part, or if the die has a different spatial position.

In the hydroforming method made use of here, water, oil, or a water/oil mixture is frequently applied as the liquid for filling the part to be shaped. Typical high internal pressures are in the range of from 1000 to 6000 bars. For tube sections having large inside diameters, lower pressures are required; for tube sections having smaller inside diameters, higher pressures need to be provided for this method.

In an advantageous variant of the method, the depression in the lower part of the die includes a step along its periphery to receive a flange. During the shaping process, the high internal pressure presses the wall of the tube section that is adjacent to the flange through the flange, with an annular collar developing which establishes a form-fitting connection with the flange. This has the advantage above all that the connection between the annular collar and the flange exhibits practically no gap, which facilitates the necessary welding process that follows and, in addition, markedly increases the quality of the weld at the joint.

In a further development of the method according to the invention for the manufacture of valve housings, subsequent to connecting the flange and the tube section, the flat is pressed towards the center axis of the tube section by the action of an external radial force. This causes the annular collar to be beaded over and engage around the flange.

All of the manufacturing steps described above are advantageously carried out in one single die. Several steps can thereby be saved because the tube section to be shaped need not be removed from one die and then be placed in one or more other dies, which would each time require a careful positioning of the workpiece.

In a further variant of the method, the lower part of the die includes a separating plate that is displaceable transversely to the axis of the tube section and has the depression arranged therein. Upon a rapid displacement of the separating plate outwards while simultaneously maintaining the high internal pressure, the flat is blown off and the opening is produced. This has the advantage that a further manufacturing step can be carried out in the same die and the flat need not be severed off separately by milling, for example. This means that the tube section is placed in the die where several process steps are automatically performed in succession with the aid of known machine control technology, and the valve housing blank may be removed along with the flange and the beaded annular collar and with the opening already formed. Thus, to finish the valve housing, only the welding or soldering process is still necessary. In this way, the entire process of manufacturing metallic valve housings can be considerably simplified.

In one example variant of the method, the lower part of the die has a sharp edge on its inner wall against which the annular collar rests, in the separating plane to the separating plate. This has the advantage that the periphery of the opening that is obtained when the flat is blown off has a clean and even contour. As an alternative, the sharp edge may be arranged on the peripheral edge of the depression in the separating plate.

It has been found to be convenient to provide the tube ends of the tube section to be shaped in the die with pressure ports having a duct. This duct is made use of for filling the tube section with liquid and for application of pressure, or for deaeration.

In a further variant of the method, the pressure ports have a conical geometry on the sides facing the tube ends and establish a force-fitting connection with the tube ends. This has the advantage that no extra sealing member and, hence, no part liable to wear is required.

The conical pressure ports may be axially fed in the shaping process when the tube ends move towards the stamp. This causes the tube section material to flow, as a result of which uniform wall thicknesses are produced in the valve housing.

The application of this sealing principle by conical sealing connections is feasible in a very large pressure range and works even in the case of extremely high pressures as are necessary for the shaping of tube sections having small diameters. "Small" diameters more particularly means nominal widths as from/below nominal diameter 25 mm (DN 25) here.

As an alternative sealing principle for sealing the pressure ports against the tube ends, radial sealing members are employed. The pressure ports are inserted into both tube ends and held by support plates which are anchored in the upper part of the die and establish a latching connection with the lower part of the die. In this case, the material of the tube section flows during the shaping process without the pressure ports being axially fed. This sealing principle is confined to a limited pressure range and, more specifically, can not be made use of for shaping tube sections having small diameters.

For the method of manufacturing, according to the invention, of metallic valve housings, stainless steel has been found to be a material that is particularly suitable for the tube section. But other metallic materials may also be used.

These and other features of the present invention can be best understood from the following specification and drawings, of which the following is a brief description.

DETAILED DESCRIPTION

Figure 1:
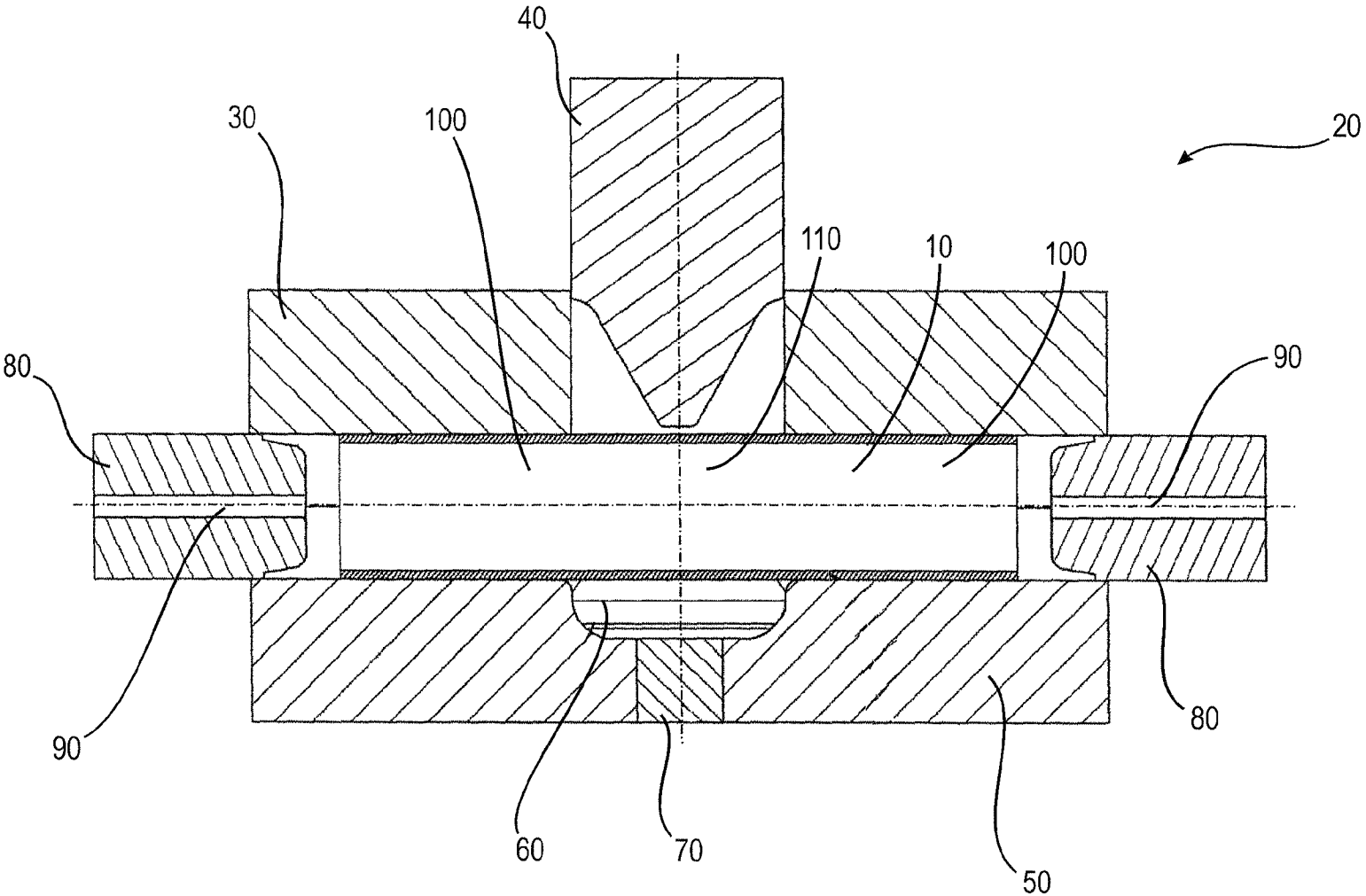
FIG. 1 shows a sectional drawing of a tube section in a die for a method according to the invention.
Figure 2:
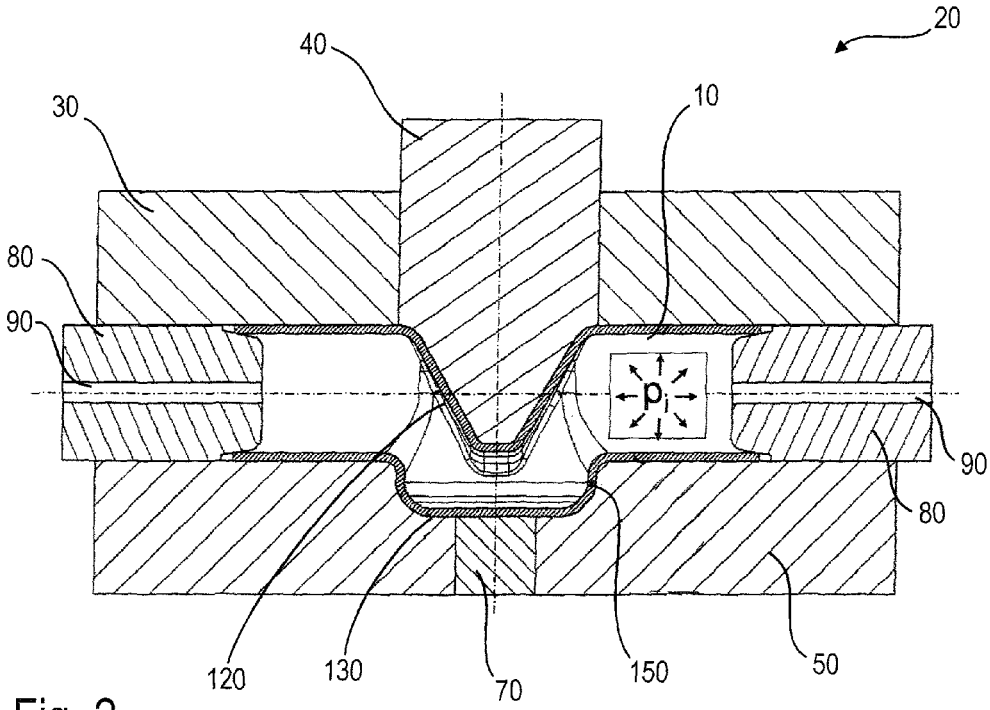
FIG. 2 shows a sectional drawing of a shaped tube section in the die.

FIG. 1 shows a tube section 10 placed inside a die 20. The die 20 includes an upper part 30 with a stamp 40, a lower part 50 with a depression 60 and an ejector 70, and two pressure ports 80 each having a duct 90. The pressure ports 80 are connected to the tube ends 100 of the tube section 10 and are filled with a liquid, in particular water or a water/oil mixture, through the duct 90, and acted upon with pressure. The pressure ports 80 have a conical geometry on the sides facing the tube ends 100 and establish a force-fitting connection with the tube ends 100, as shown in FIG. 2. In the shaping process, when the tube ends 100 move towards the stamp, the conical pressure ports 80 can be axially fed. This causes the material of the tube section to flow, as a result of which uniform wall thicknesses advantageously develop in the valve housing. Owing to the conical geometry of the pressure ports 80, the sealing against the high internal pressure can be achieved without the use of an additional seal. This sealing principle allows a reliable sealing effect to be obtained over a large pressure range. Even tube sections having nominal diameters of below DN 25 can be shaped; this requires pressures of around 6000 bars.

According to FIG. 2, the stamp 40 is pressed inwards transversely to the axis of the tube section 10 in the middle portion 110 thereof, so that the wall of the tube section 10 facing the stamp 40 adapts to the contour of the stamp 40 to form a concave curvature 120. On the opposite side, the wall of the tube section 10 is pressed into the depression 60 by the high internal pressure applied and forms the flat 130 there. It is of particular advantage here that very tight tolerances can be met because the high internal pressure makes sure that after the shaping process, the wall of the original tube section 10 exactly reproduces the contour of the depression 60. In this method, a very high process reliability can be ensured since the latter is highly dependent on the high internal pressure, which, however, is well adjustable.

Figure 2A:
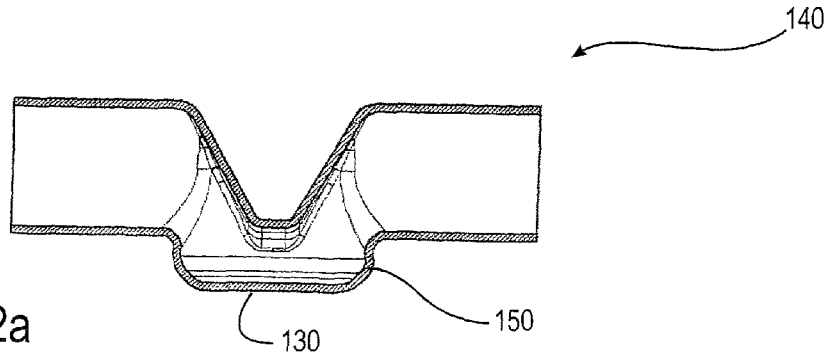
FIG. 2*a* shows a sectional drawing of a valve housing blank manufactured according to FIGS. 1 and 2.

The metallic valve housing blank 140 manufactured according to the invention and illustrated in FIG. 2*a* is machined further in a known manner: the flat 130 is severed off to form an opening and the remaining annular collar 150 is beaded around a flange. Subsequently, the annular collar 150 and the flange are welded or soldered to each other.

Figure 3:
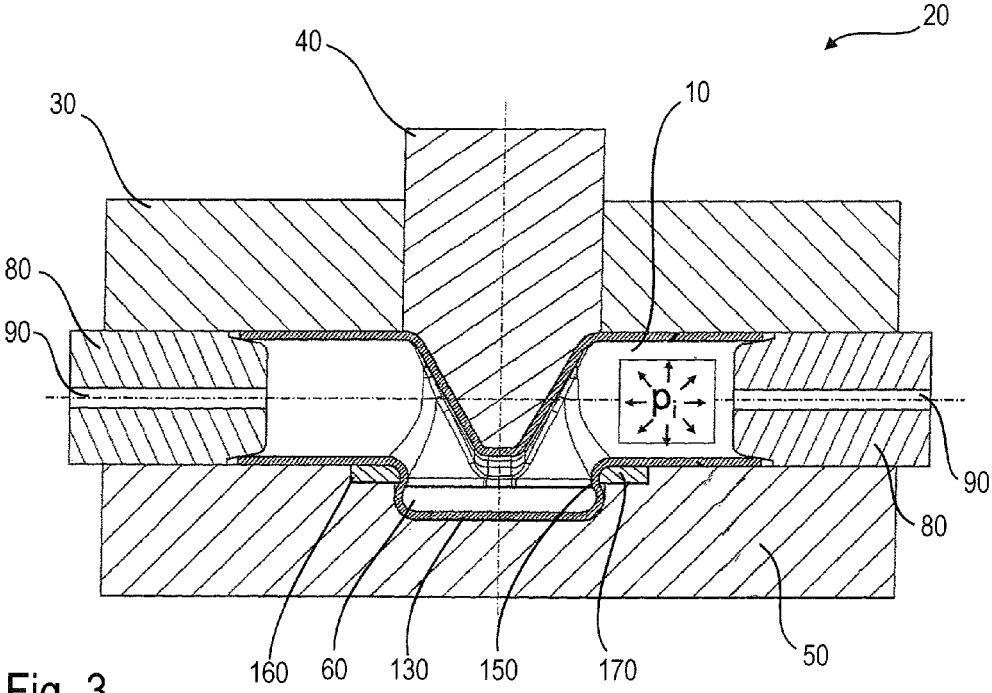
FIG. 3 shows a sectional drawing of a shaped tube section in the die for a variant of the method.
Figure 3A:
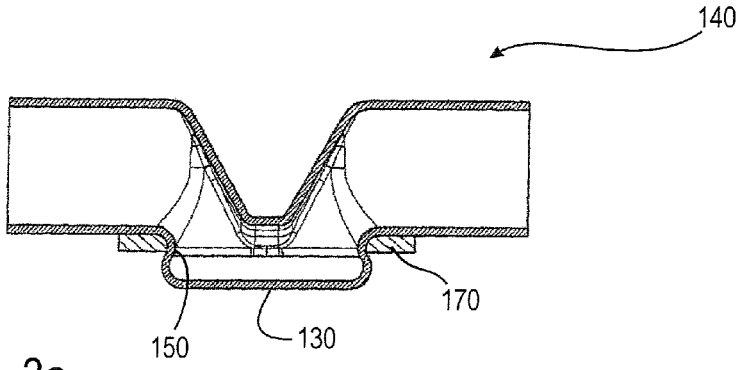
FIG. 3*a* shows a sectional drawing of a valve housing blank manufactured according to FIG. 3.

In contrast to FIG. 2, the lower part 50 of the die 20 in FIG. 3 includes a step 160 along the periphery of the depression 60 to receive a flange 170. By application of a high internal pressure, the wall of the tube section 10 facing the depression 60 is pressed through the flange 170 into the depression 60 to the flat 130 while producing a form-fitting connection of the annular collar 150 and the flange 170. This saves a method step, and a practically gap-free connection between the annular collar 150 and the flange 170 is obtained. In this way, the subsequently necessary welding process following the severing of the flat 130 is simplified and the welded joint exhibits a distinctly improved quality.

Figure 4:
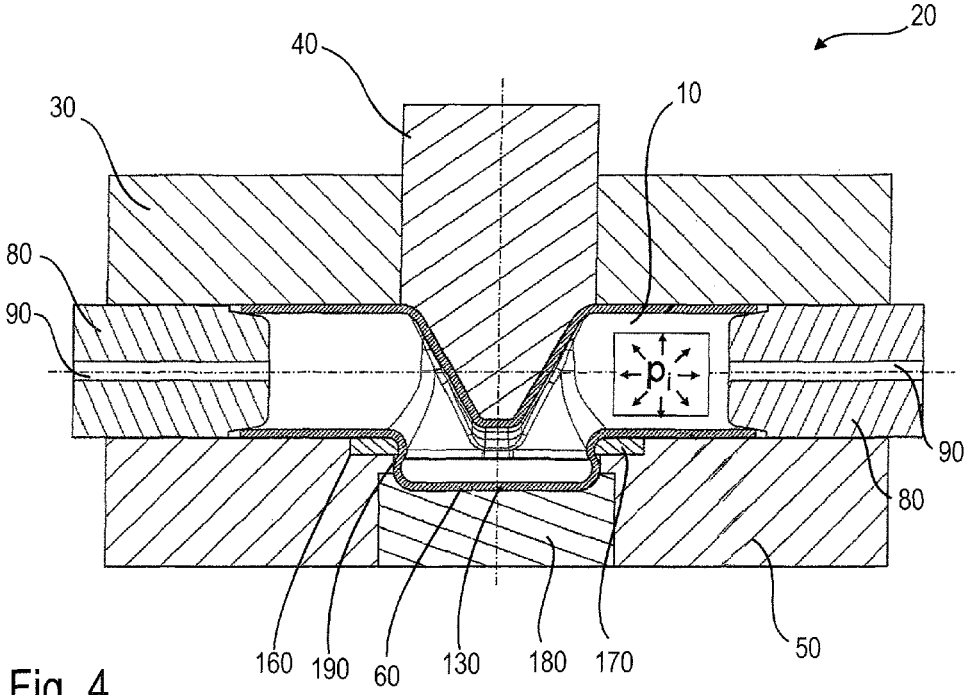
FIG. 4 shows a sectional drawing of a shaped tube section for a variant of the method, in the closed die.
Figure 5:
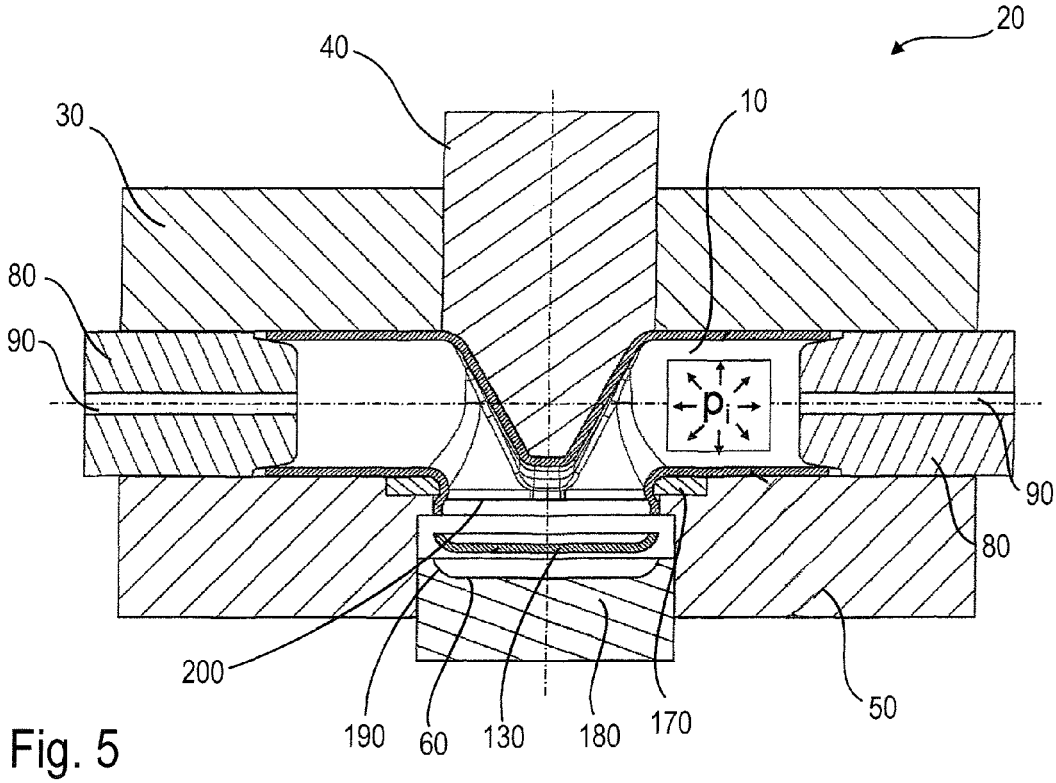
FIG. 5 shows a further sectional drawing of a shaped tube section for the variant of the method according to FIG. 4, in the closed die.
Figure 6:
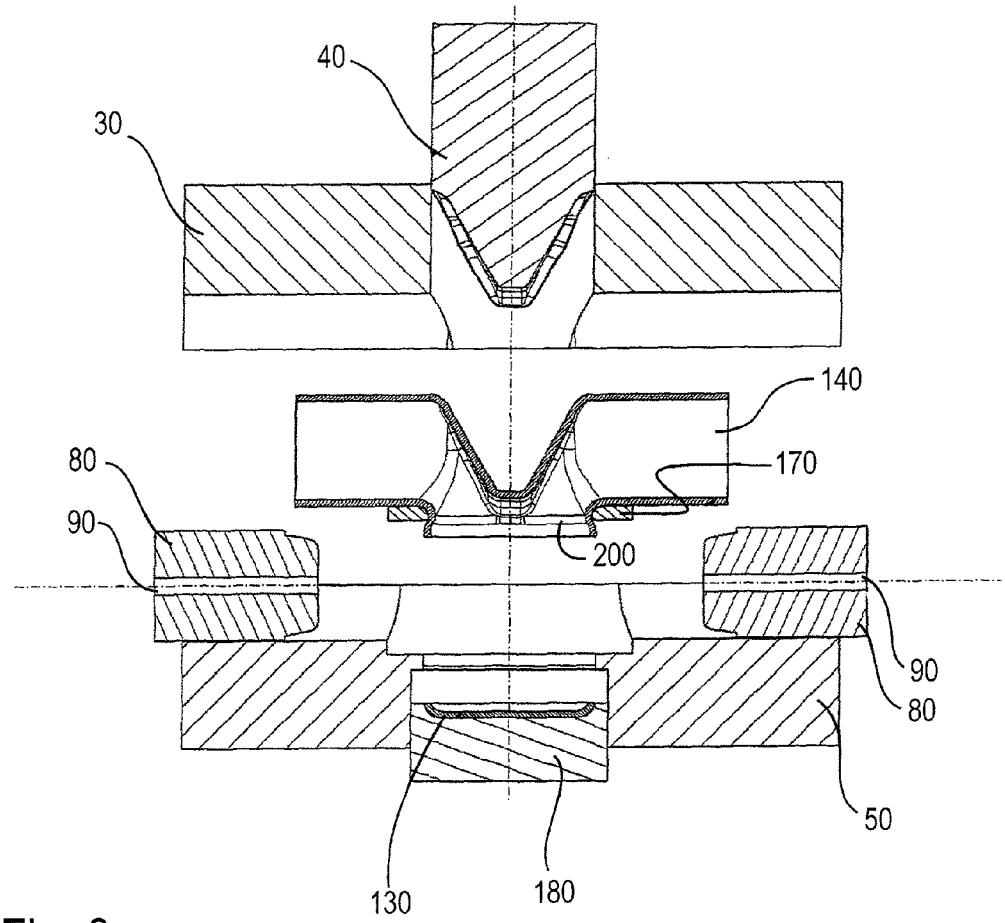
FIG. 6 shows a sectional drawing of a shaped tube section for a variant of the method according to FIGS. 4 and 5, with the die opened.

FIGS. 4 to 6 show a further development of the method illustrated in FIG. 3.

FIG. 4 shows the tube section 10 in the die 20 with upper part 30 and stamp 40, pressure ports 80 and duct 90, step 160 for receiving the flange 170, as well as the lower part 50, which now includes a separating plate 180 which is displaceable transversely to the axis of the tube section 10. Arranged in the separating plate 180 is the depression 60 which features a sharp edge 190 at its peripheral edge. As already described above, in this variant of the method, too, the wall of the tube section 10 on one side thereof adapts to the contour of the stamp 40, and the opposite wall is pressed downward and outward by a high internal pressure. In the further development, the wall is now pressed through the flange 170 into the depression 60 to form the flat 130. According to FIG. 5, upon a rapid displacement of the separating plate 180 by a short distance outwards, away from the tube section, the flat 130 is blown off along the sharp edge 190. After opening the die, as shown in FIG. 6, the valve housing blank 140 can be removed. This variant of the method has the advantage that a further manufacturing step can be carried out in the same die. Severing off the flat 130 by milling, which is usually required, is dispensed with. The valve housing blank 140 removed from the die already features the opening 200. The sharp edge 190 contributes to the production of a clean and even contour of the periphery of the opening 200 when the flat 130 is blown off.

Figure 6A:
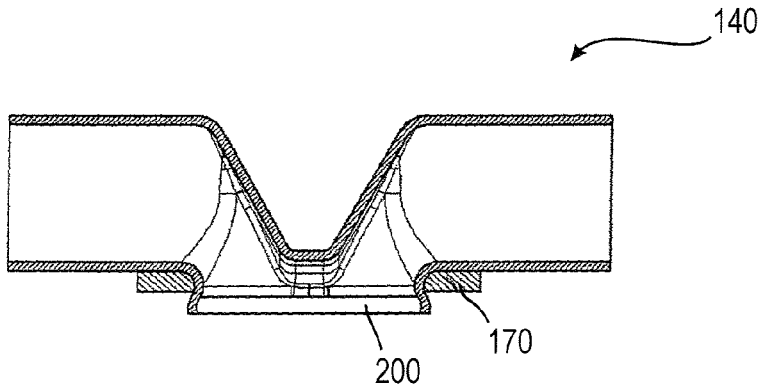
FIG. 6*a* shows a sectional drawing of a valve housing blank manufactured according to FIGS. 4-6.
Figure 6B:
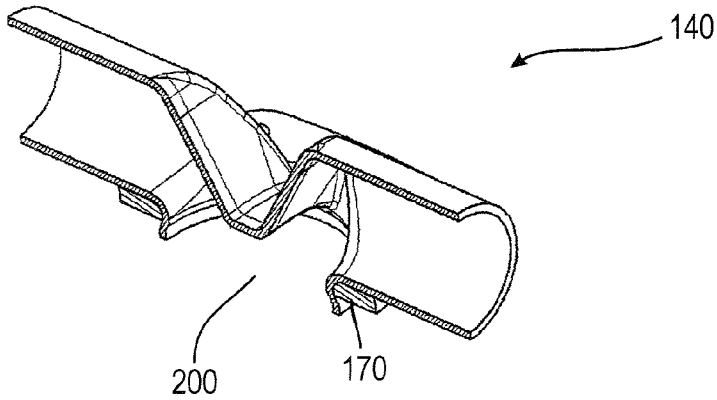
FIG. 6*b* shows a further sectional drawing of the valve housing blank manufactured according to FIGS. 4-6.
Figure 7:
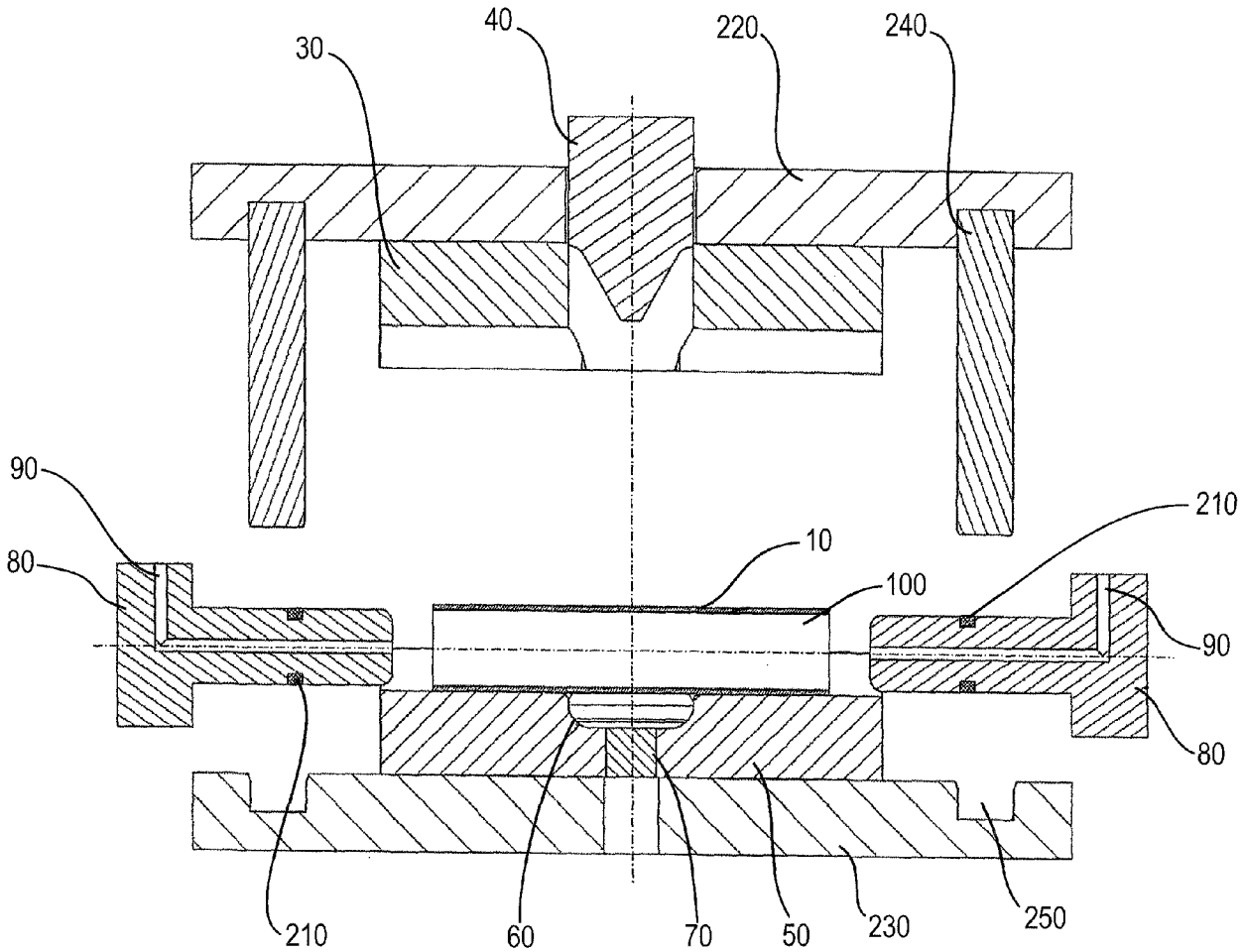
FIG. 7 shows a sectional drawing of a tube section in the open die for a further variant of the method.
Figure 8:
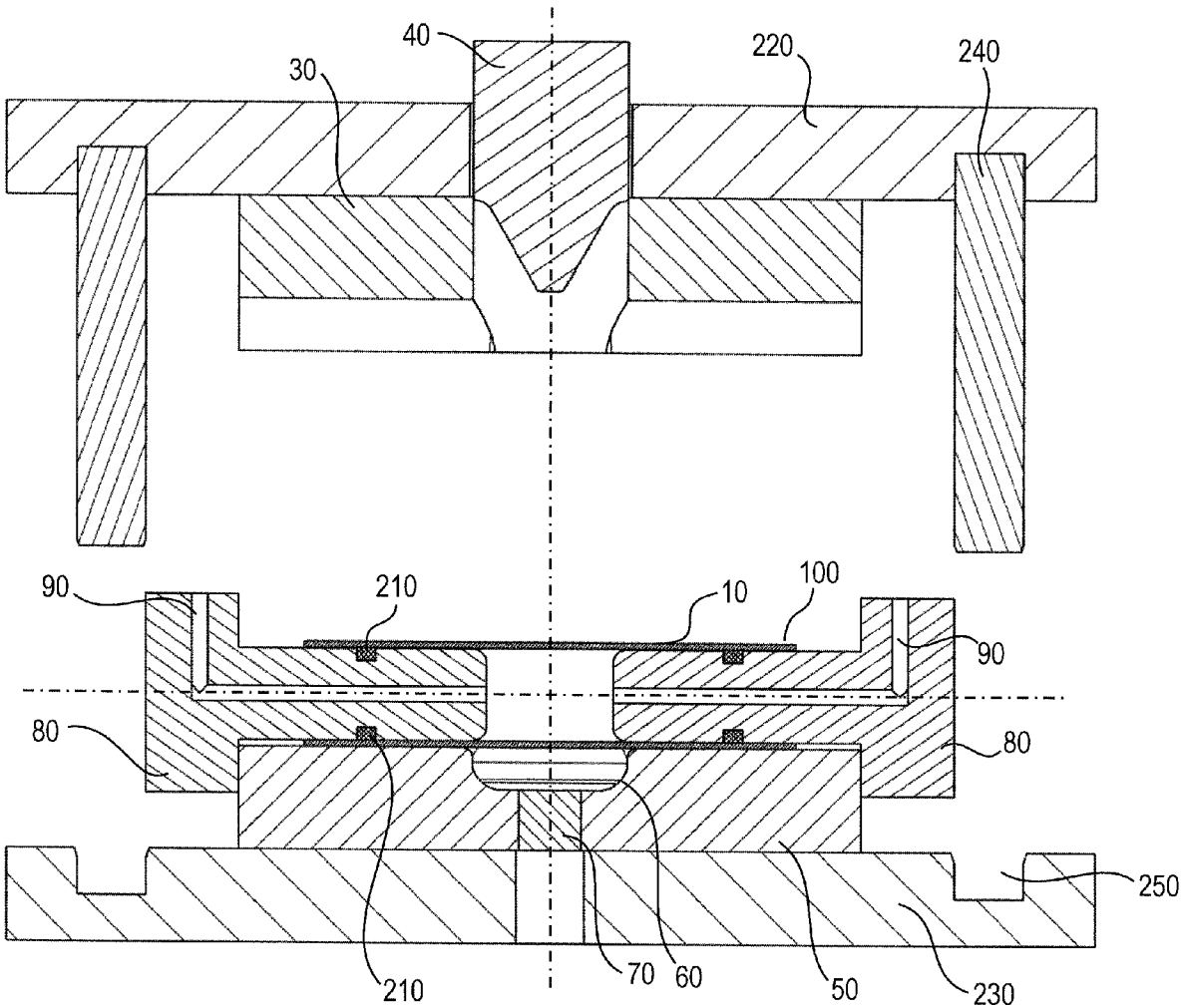
FIG. 8 shows a sectional drawing of a tube section in the open die according to FIG. 7, in which the pressure ports have been moved into the tube section.
Figure 9:
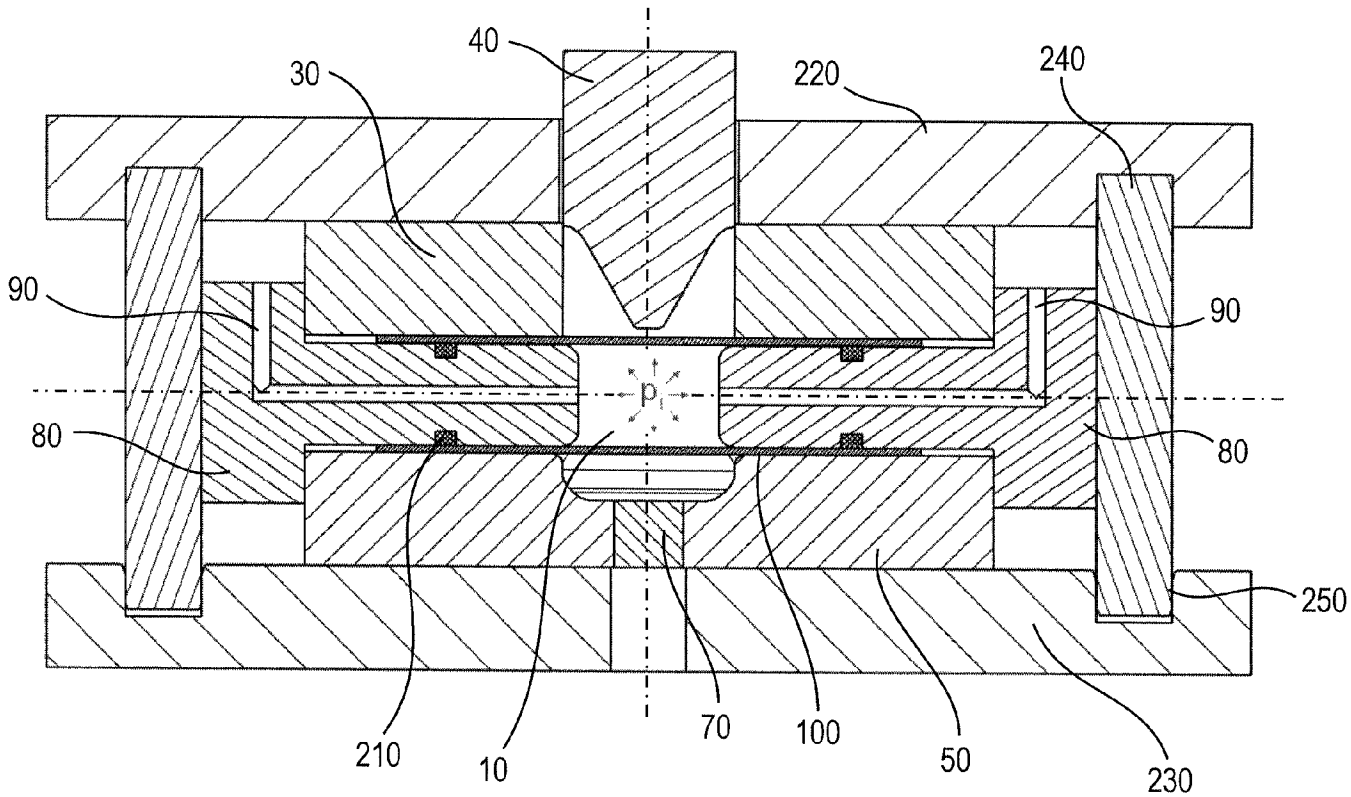
FIG. 9 shows a further sectional drawing of a tube section in the closed die according to FIGS. 7 and 8, in which the tube section has not yet been shaped.
Figure 10:
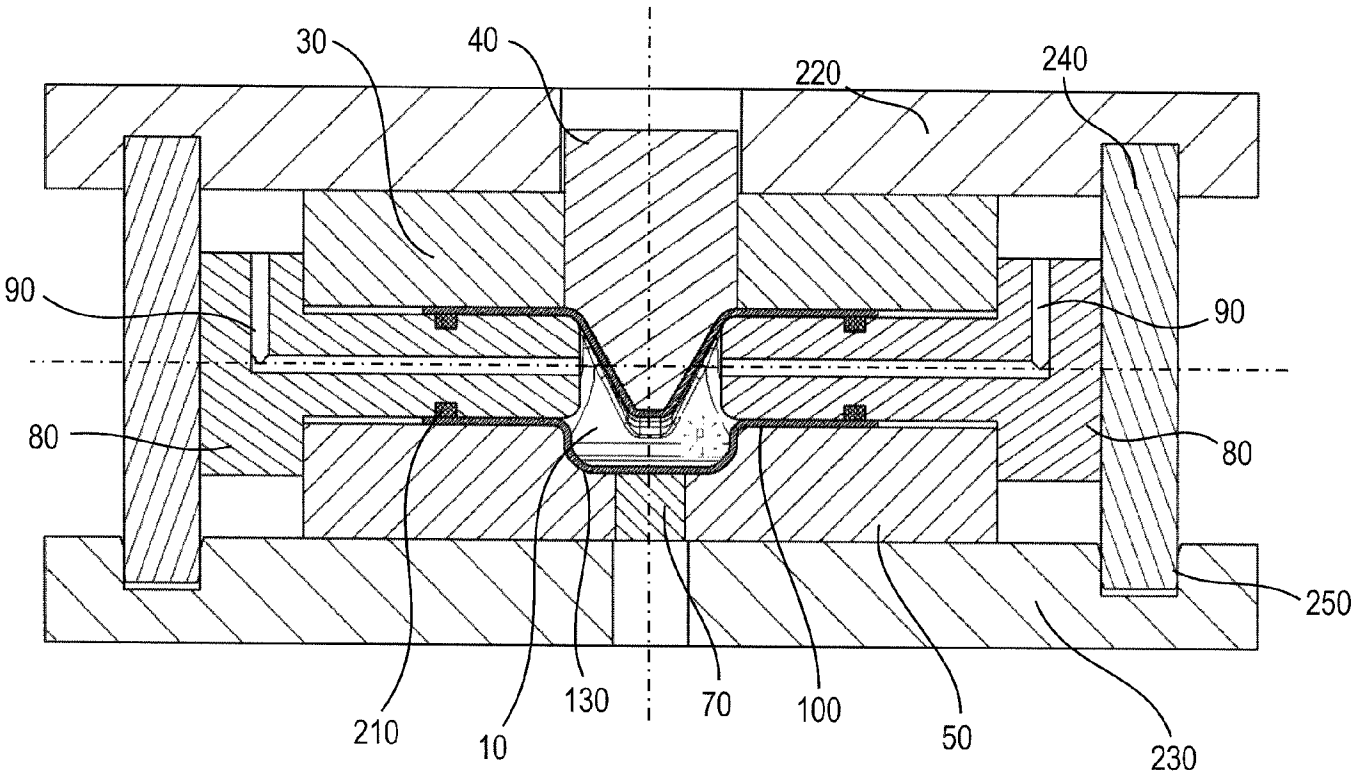
FIG. 10 shows a further sectional drawing of a shaped tube section in the die according to FIGS. 7, 8 and 9.

FIGS. 6*a* and 6*b* show sectional drawings of the valve housing blank 140 manufactured according to the method as illustrated in FIGS. 4 to 6. The valve housing blank 140 exhibits the concave curvature 120, the opening 200 facing it, the flange 170 and the annular collar 150, which is connected in a form-fitting manner with the flange 170.

FIGS. 7 to 10 illustrate a further variant of the method, which is preferably used for lower internal high pressures. This variant of the method is primarily suitable for the shaping of tube sections having larger diameters and nominal widths of greater than DN 25.

The pressure ports 80 include radial sealing members 210 and are pushed into the tube ends 100. The die 20 comprises an upper part 30 with a stamp 40 and a lower part 50 with a depression 60 and an ejector 70. The upper part 30 and the lower part 50 are arranged between an upper base plate 220 and a lower base plate 230. The upper base plate 220 includes two support plates 240.

With the die 20 closed, the tube section 10 with the pressure ports 80 is arranged between the support plates 240 (see FIG. 10), the latter penetrating into recesses 250 of the lower base plate 230. In this case, the material of the tube section 10 flows during the shaping process without the pressure ports 80 being separately axially fed.

This variant of the method featuring radial sealing members 210 on the pressure ports 80 may, of course, also be applied to the methods in which the flange 170 is connected with the tube section 10 in the die 20, the annular collar 150 is beaded around the flange 170, or the flat 130 is blown off.

Figure 11:
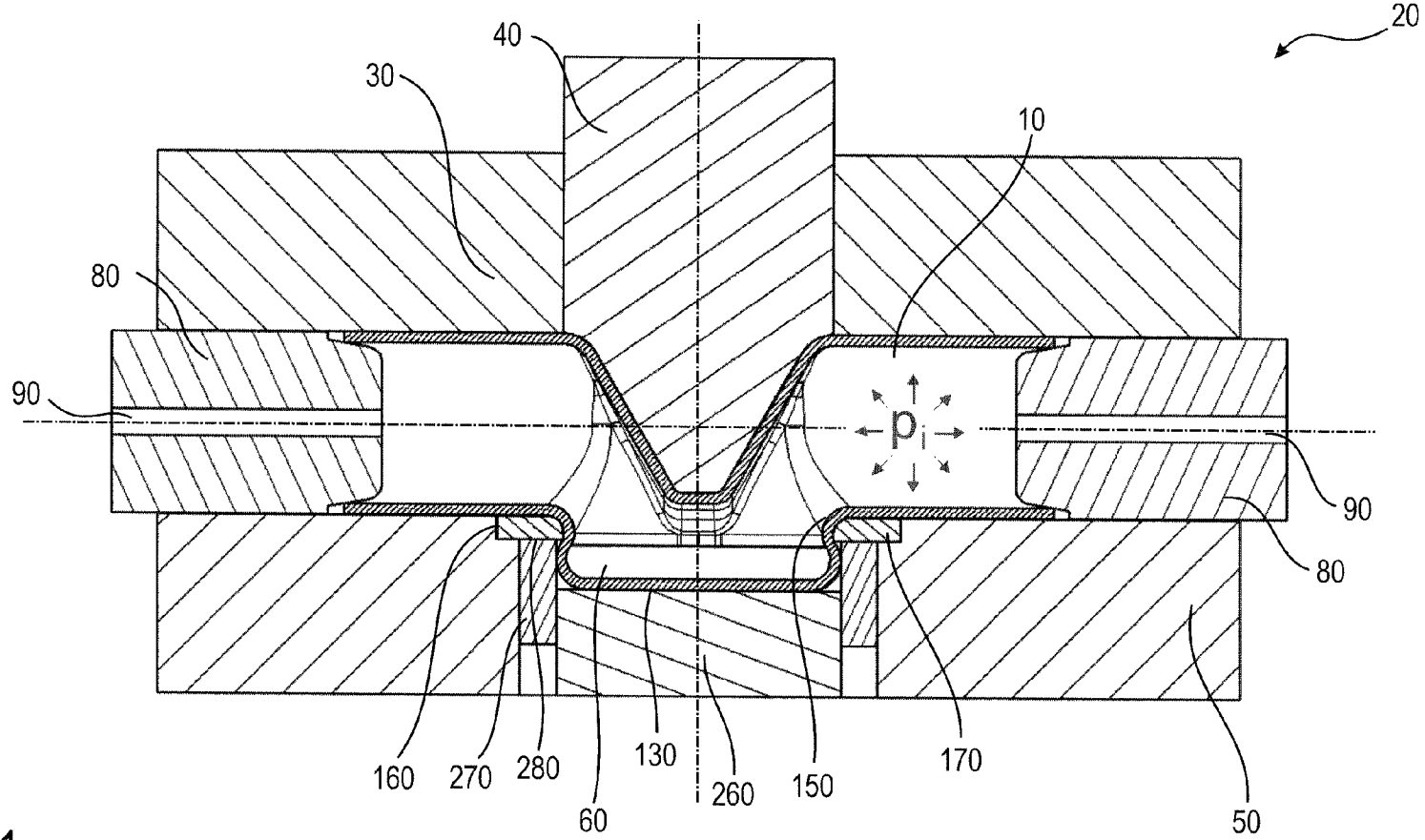
FIG. 11 shows a sectional drawing of a shaped tube section for a further variant of the method.
Figure 12:
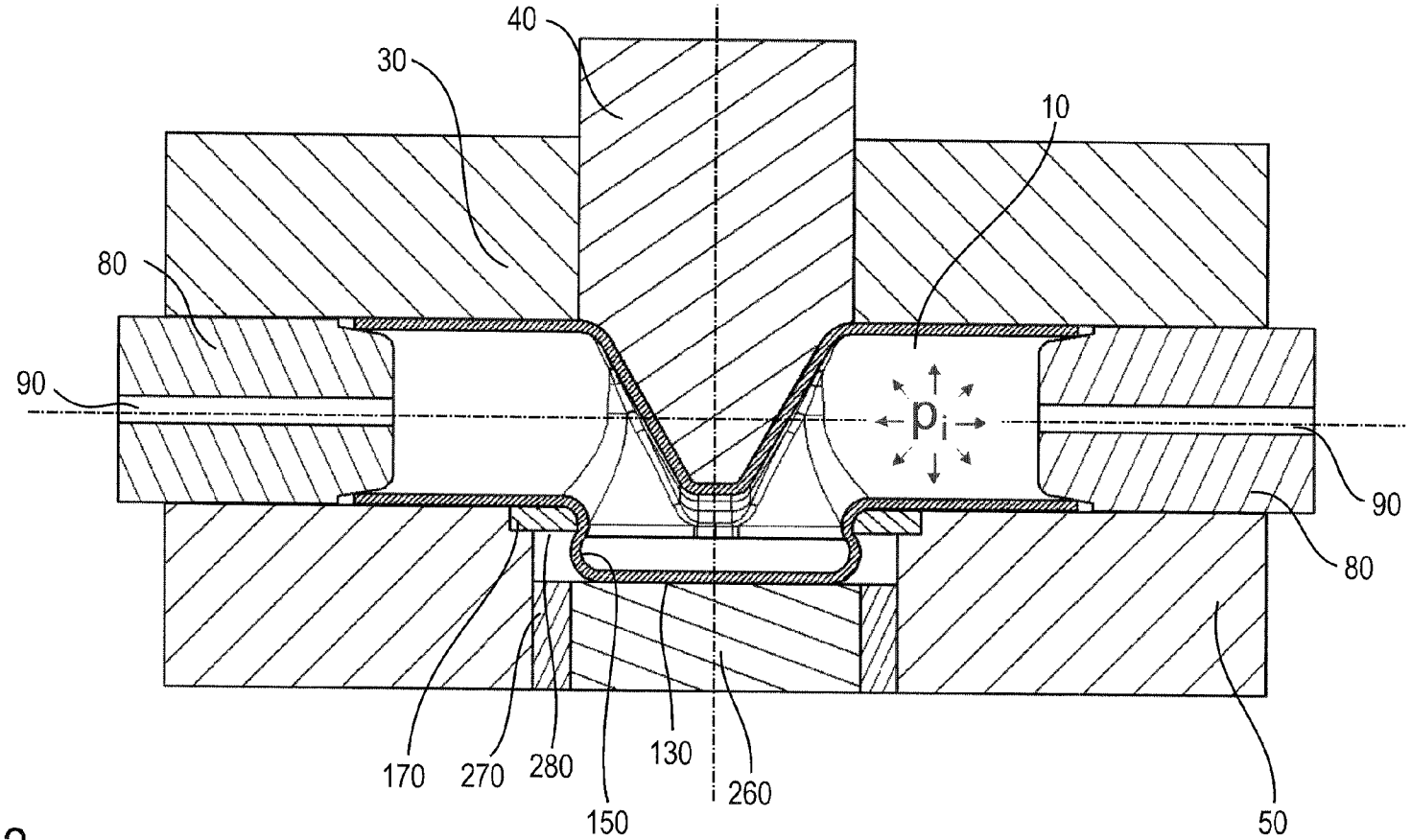
FIG. 12 shows a sectional drawing of a shaped tube section according to the variant of the method shown in FIG. 11 in a subsequent method step.
Figure 13:
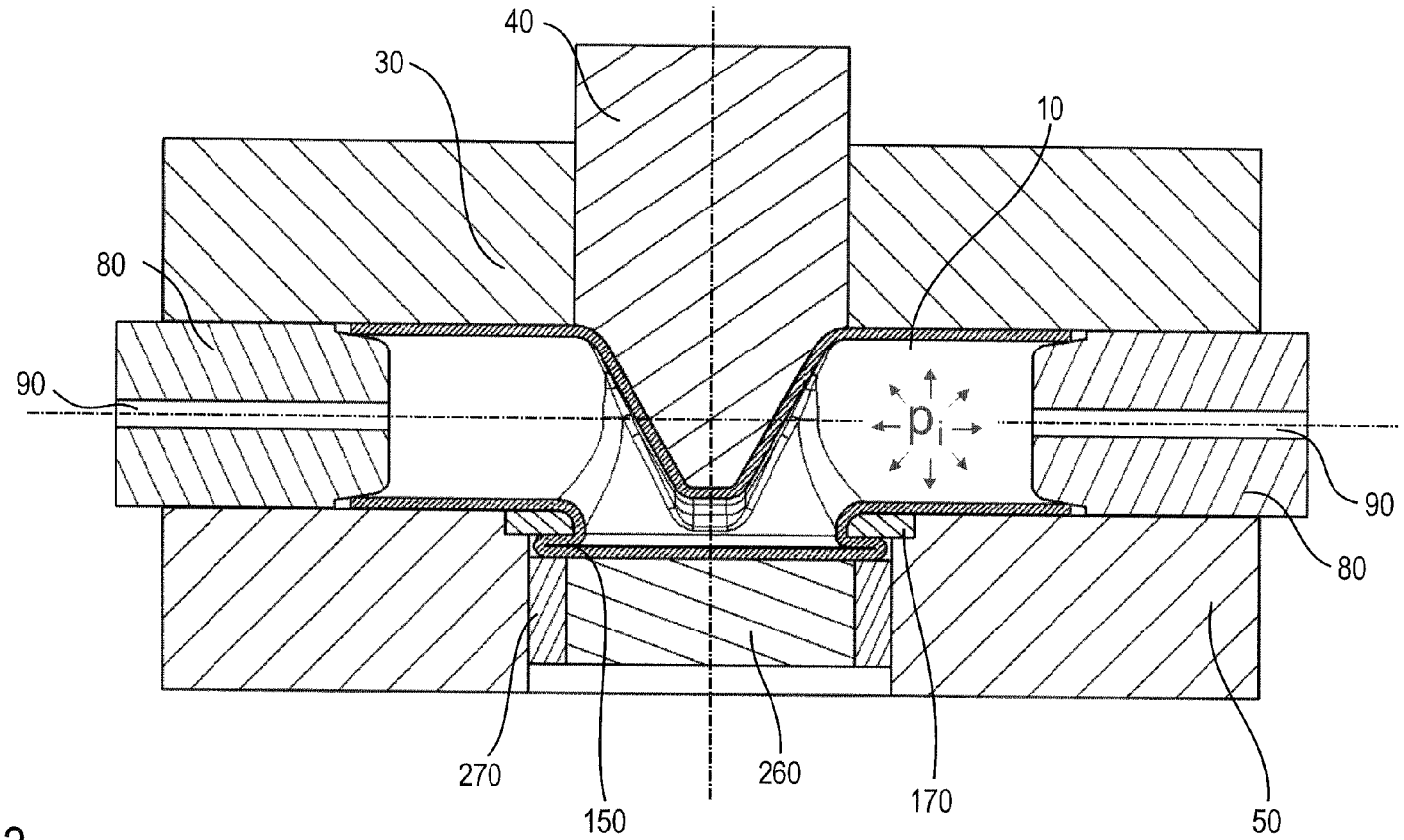
FIG. 13 shows a further sectional drawing of a shaped tube section according to the variant of the method shown in FIG. 11 in a concluding method step.

FIGS. 11 to 13 illustrate a variant of the method of manufacturing metallic valve housings.

FIG. 11 shows a shaped tube section 10 in the die 20 having the upper part 30 and the stamp 40, as well as the lower part 50 having a step 160 to receive a flange 170. The lower part 50 includes a disk 260 and a support ring 270 closely surrounding the disk 260, both of which are displaceable transversely to the axis of the tube section 10, both individually and jointly. The support ring 270 rests on the flange 170 by a front face 280. The inner wall of the support ring 270, together with the side of the disk 260 facing the tube section 10, forms the depression 60 in that the disk 260 is slightly shifted outwards in relation to the support ring 270, away from the tube section 10.

The geometry of the valve housing blank is initially produced in the same way as described above upon displacement of the stamp 40 transversely to the axis of the tube section 10 and application of a high internal pressure to the tube section 10. The wall of the tube section 10 facing the depression 60 is pressed through the flange 170 into the depression 60 to form the flat 130 and the annular collar 150. The support ring 270 prevents an uncontrolled shaping of the tube section 10 in the bottom portion of the flat 130.

According to FIG. 12, the support ring 270 is subsequently shifted outwards transversely to the axis of the tube section 10, away from the flange 170, until the front face 280 of the support ring 270 that is adjacent to the flange 170 constitutes a plane with the side of the disk 260 facing the tube section 10.

Then the flat 130 is pressed radially inwards towards the axis of the tube section by means of the support ring 270 and the disk 260 until it is in contact with the flange 170, as shown in FIG. 13. The annular collar 150 is thereby beaded over and engages around the flange 170. In a further method step, the flat 130 may be blown off, as described above. Here, the sharp edge may also be arranged on the front face of the flange.

The method according to the invention and the variants of the method of manufacturing valve housings are particularly suited for the shaping, by means of high internal pressure, of tube sections made from stainless steel. But tube sections made from other metallic materials may also be used.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of manufacturing a metallic valve housing by hydroforming a tube section in a die including an upper part having a stamp and a lower part having a depression, the method comprising the following steps:

placing the tube section in the die;

filling the tube section with a liquid to subject the tube section to a high internal pressure; and shaping opposite walls of the tube section in a middle portion of the tube section between two tube ends of the tube section by pressing one side of the tube section inwards transversely to a center axis of the tube section with the stamp to form a concave curvature serving as a threshold and valve seat between a fluid input and a fluid output of a valve formed by the tube ends, and pressing the opposite wall into the depression in the lower part to form a flat.

2. The method of manufacturing a metallic valve housing according to claim 1, wherein the depression in the lower part of the die includes a step along a periphery of the depression to receive a flange, and wherein the method further comprises the step of pressing the wall of the tube section that is adjacent to the flange through the flange and into the depression to form an annular collar that establishes a form-fitting connection with the flange that is gap-free.

3. The method of manufacturing a metallic valve housing according to claim 2, further comprising the step of pressing the flat towards the center axis of the tube section in the die by action of an external radial force, whereby the annular collar engages around the flange.

4. The method of manufacturing a metallic valve housing according to claim 1, wherein the lower part of the die includes a separating plate that is displaceable transversely to the center axis of the tube section and has the depression arranged therein, the method further including the step of rapidly displacing the separating plate while maintaining the high internal pressure to blow off the flat.

5. The method of manufacturing a metallic valve housing according to claim 4, wherein the lower part of the die has a sharp edge on an inner wall of the die against which the annular collar rests, in the separating plane to the separating plate.

6. The method of manufacturing a metallic valve housing according to claim 1, wherein pressure ports are connected to both tube ends in the extensions thereof, the pressure ports each having a duct for supplying a liquid and for applying pressure, or for deaeration.

7. The method of manufacturing a metallic valve housing according to claim 6, wherein the pressure ports have a conical geometry on sides facing the tube ends and establish a force-fitting connection with the tube ends.

8. The method of manufacturing a metallic valve housing according to claim 6, wherein the pressure ports are axially fed towards the tube section during the shaping process when the tube section material flows.

9. The method of manufacturing a metallic valve housing according to claim 6, wherein the pressure ports are moved into both tube ends and are sealed in both tube ends by radial sealing members.

10. The method of manufacturing a metallic valve housing according to claim 9, wherein the pressure ports, when in a moved-in position, are held by support plates which are anchored in the upper part of the die and establish a latching connection with the lower part of the die.

11. The method of manufacturing a metallic valve housing according to claim 1, wherein the tube section comprises stainless steel.

12. The method of manufacturing a metallic valve housing according to claim 1, including the step of severing off the flat to form an opening in the tube section.

13. The method of manufacturing a metallic valve housing according to claim 12, wherein severing off the flat provides an annular collar surrounding the opening, and including the step of attaching a flange to the annular collar.

14. The method of manufacturing a metallic valve housing according to claim 12, wherein the step of severing of the flat is performed by milling.

15. The method of manufacturing a metallic valve housing according to claim 12, including providing a separating plate in the lower part of the die, and wherein the step of severing of the flat is performed by applying a high internal pressure while rapidly displacing the separating plate in a direction away from the center axis.

* * * * *